US007815372B2

(12) United States Patent
Stanton et al.

(10) Patent No.: US 7,815,372 B2
(45) Date of Patent: Oct. 19, 2010

(54) POP-UP DISPOSABLE BAG

(76) Inventors: John William Stanton, 4249 Rivermark Pkwy., Santa Clara, CA (US) 95054; Ronald Ghee Jin Ong, 10213 S. Portal Ave., Cupertino, CA (US) 95014

( * ) Notice: Subject to any disclaimer, the term of this patent is extended or adjusted under 35 U.S.C. 154(b) by 1000 days.

(21) Appl. No.: 11/505,238

(22) Filed: Aug. 15, 2006

(65) Prior Publication Data

US 2008/0056625 A1 Mar. 6, 2008

Related U.S. Application Data

(60) Provisional application No. 60/708,303, filed on Aug. 13, 2005.

(51) Int. Cl.

| | |
|---|---|
| ***B65D 30/16*** | (2006.01) |
| ***B65D 33/06*** | (2006.01) |
| ***B65D 30/10*** | (2006.01) |
| ***A63B 55/04*** | (2006.01) |

(52) U.S. Cl. ..... 383/104; 383/6; 220/9.3; 248/97

(58) Field of Classification Search ..... 383/2, 383/104, 6; 248/97, 150, 153; 220/9.2, 9.3, 220/9.4

See application file for complete search history.

(56) References Cited

U.S. PATENT DOCUMENTS

| | | | | |
|---|---|---|---|---|
| 400,588 | A * | 4/1889 | Meyering | 43/56 |
| 3,014,516 | A | 12/1961 | Mueller | |
| 4,759,518 | A * | 7/1988 | Yardas | 248/97 |
| 4,815,784 | A | 3/1989 | Zheng | |
| 4,899,967 | A * | 2/1990 | Johnson | 248/97 |
| 5,022,767 | A * | 6/1991 | Cardulla | 383/33 |
| 5,046,860 | A | 9/1991 | Brennan | |
| 5,393,023 | A * | 2/1995 | Callan | 248/97 |
| 5,964,533 | A | 10/1999 | Ziglar | |
| 6,006,772 | A | 12/1999 | Zheng | |
| 6,065,873 | A | 5/2000 | Fowler | |
| 6,179,150 | B1 | 1/2001 | Fogler | |
| 6,212,792 | B1 * | 4/2001 | Bier | 34/315 |
| 6,315,143 | B1 * | 11/2001 | Dotts | 220/9.2 |
| 6,334,710 | B1 | 1/2002 | Kuge et al. | |
| 6,431,230 | B1 | 8/2002 | Tsigas | |
| 2005/0284866 | A1 | 12/2005 | Oakner et al. | |

* cited by examiner

*Primary Examiner*—Jes F Pascua

(57) ABSTRACT

Pop-up disposable bag is formed of light-weight disposable bag assembly capable of self erecting and self-standing. It does not require any stakes, poles, ropes or additional supports or frame to support it. The entire bag assembly is flexible and can be folded to a compact form for packaging and sale and can easily be opened into a self-standing position by removing the retainer.

5 Claims, 6 Drawing Sheets

POP-UP DISPOSABLE BAG

This application claims the benefit of my provisional Patent Application No. 60/708,303 filed on Aug. 13, 2005, which is hereby incorporated by reference herein.

BACKGROUND OF THE INVENTION

1. Field of Invention

The present invention is directed to an enhanced need for disposable bags which are used for holding garbage or yard waste that can be compactly packaged for easy transport but also subsequently easily erected into a free standing upright receptacle with open top without the use of any separate frame or any additional container.

2. Description of the Related Art

It is well known to provide disposable bags formed from a tube of plastic which are used as garbage bags for holding disposable garbage. These bags generally require external supports and a structure to keep them upright and also to keep the top open while being filled. Such disposable bags, if not supported and held adequately, tend to lose shape or fall over and are somewhat difficult to fill compactly.

It is another problem that in general the supporting structure of disposable bags which are made of steel wires and steel coils are bulky, clumsy and difficult to keep fully expanded. Also, the disposable bags, even when supported, can easily tip and blow over by a slight uneven filling.

It is noted that the structure and the fittings for holding the bags often pinch through the bag enclosure and renders them unusable. Accordingly, these disposable bags cannot be used to hold a substantial weight of yard waste due to their unstable and crude supporting structure.

It is further noted that collapsible containers are well known to be used as pop-up laundry hampers. These containers are formed from a fabric covering at least three foldable frame members which are more expensive to produce and are not disposable.

The following prior art documents disclose examples of existing collapsible bags or containers which could be used for holding garbage and yard waste.

U.S. Patent Application No. 2005/0284866 A1 published on Dec. 29, 2005 for Oakner et al disclose a disposable trash container having a lining made of plastic and comprises a free standing structure which can be collapsed flat for packing and which is self opened to an expanded open position.

U.S. Pat. No. 6,179,150 B1 issued on Jan. 30, 2001 to Fogler discloses a collapsible bag for collecting refuse, such as grass cuttings, leaves or other debris. The invention discloses a light weight frame which can be folded and unfolded which is adapted for insertion into a collapsible bag for keeping the bag open and upright position to facilitate filling the bag.

U.S. Pat. No. 6,006,772 issued on Dec. 28, 1999 to Zheng formed of a collapsible structure which can be twisted and folded to reduce the overall size of the structure to facilitate convenient storage and use. The invention is drawn to primarily store clothing, waste paper, etc., and is covered by a fabric forming an open top and side panels and bottom.

U.S. Pat. No. 5,964,533 issued on Oct. 12, 1999 to Ziglar discloses a hamper for collection, transport, and removal of goods or other articles. It is primarily used as a hamper for holding and storage of clothes for laundry. The receptacle can have a flaccid wall of a textile which is supported by a retractably collapsible support or tension member framework structure which would permit lateral collapsibility.

U.S. Pat. No. 3,014,516 issued on Dec. 26, 1961 to Mueller discloses a collapsible container for use of trash pick-up at the home or business establishment and can sustain abuse while being thrown by the trash collection people. It is formed of a helical compressive spring steel which can sustain impact and misuse during handling.

SUMMARY OF THE INVENTION

The invention is drawn to an enhanced pop-up disposable bag for holding garbage or yard waste and other material which can be compactly packed from the opening at the top while standing up-right on its bottom. The disposable bag is packaged for ease of handling and transport.

Accordingly, it is a principal object of the invention to provide a disposable bag having an integral support mechanism enabling easy use of the bag without any additional or separate support structure or container. The invention comprises elements of low cost material forming a structure and covering of the pop-up disposable bag.

It is another object of the invention to provide a lightweight, disposable assembly of a receptacle or bag with support structures that are mostly self-erecting and free standing. It will not require any stakes, poles, ropes or additional container or frame to support it. It is therefore, an integral frame of plastic and a membrane to form a disposable bag, the frame is made of a fairly rigid structure which is flexible enough to collapse but rigid enough to keep it free standing. The frame would be made from plastic or some other suitable recyclable material.

It is a further object of the invention to provide flexible connections based on spring hinges or pin connectors which provide enough flexibility in one direction so that the entire structure of the disposable bag could be folded flat by rotation of top and bottom in one direction for storage and packaging, and additionally the spring hinges or pin connectors are rigid enough to restrict bending in other directions.

It is still another object of the invention to provide a lightweight, disposable bag which is self erecting, free-standing having a flat bottom with an opening at top for filling and a method for closing it such as through the use of a draw string. It includes a membrane which is made of plastic or other flexible recyclable material which can be mounted over the tubular frame structure or can be attached inside the tubular structure.

These and other objects of the present invention will become readily apparent upon further review of the following specifications and drawings.

DRAWINGS REFERENCE NUMERALS

10—Concentric hoop members
11—Vertical members
12—Outer sheet or membrane
13—Receptacle bottom
14—Drawstring opening
15—Internal loop or sleeve
16—Spring hinge or joint
17—Inner sheet or membrane
18—Cut-out in sheet or membrane
19—Closable drawstring opening
20—External loop or sleeve
21—Pin hinge
22—Collapsible bag packet
23—Storage container
24—Handle

DETAILED DESCRIPTION OF THE INVENTION

Figure 1:
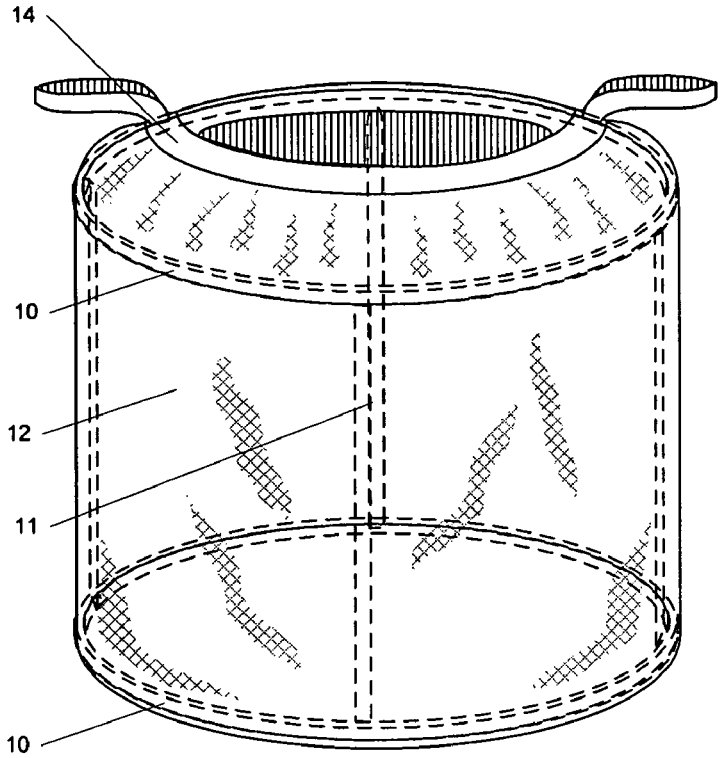
FIG. 1—Perspective top view of the receptacle in its erect form with structural members shown as dotted lines.

The present invention shown in FIG. 1, comprises a plurality of flexible hoop members 10, each member is generally oval shaped when fully expanded. These flexible hoop members are held apart by other connecting flexible vertical members 11 and form a tubular frame. The vertical members also provide good support to the top hoop and resist compression along their long axis. The hoops and the connecting vertical members which form the receptacle frame are made of plastic or some other suitable recycled material which is flexible.

Figure 2:
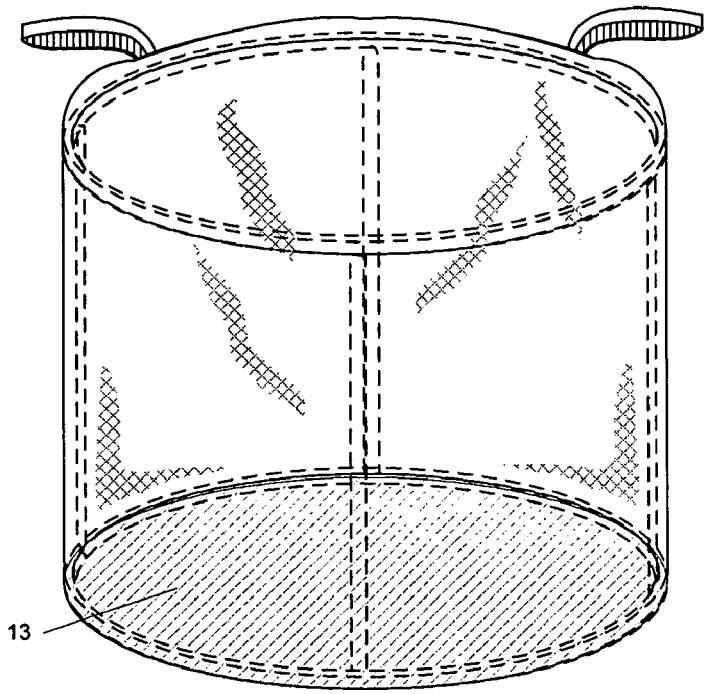
FIG. 2—Perspective bottom view of the receptacle in its erect form with structural members shown as dotted lines.

The receptacle comprises a sheet or membrane of recyclable plastic 12 which extends over the flexible structure frame formed of hoops 10 and vertical members 11 having a tubular side wall, flat circular bottom 13 and a top with an opening 14 as illustrated in FIGS. 1 and 2.

Figure 3:
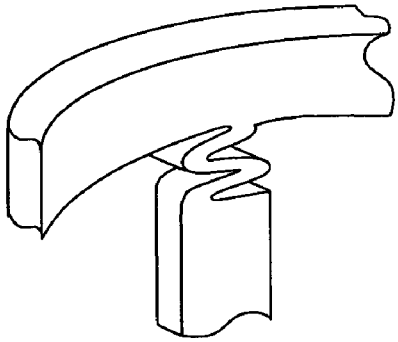
FIG. 3—Perspective view of a preferred spring joint or hinge connector where the hoop sections connect to the vertical members.
Figure 4:
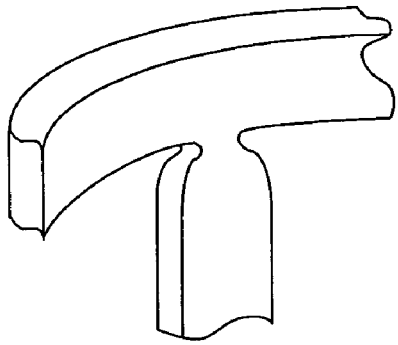
FIG. 4—Perspective view of an alternative spring joint or hinge connector where the hoop sections connect to the vertical members.
Figure 9:
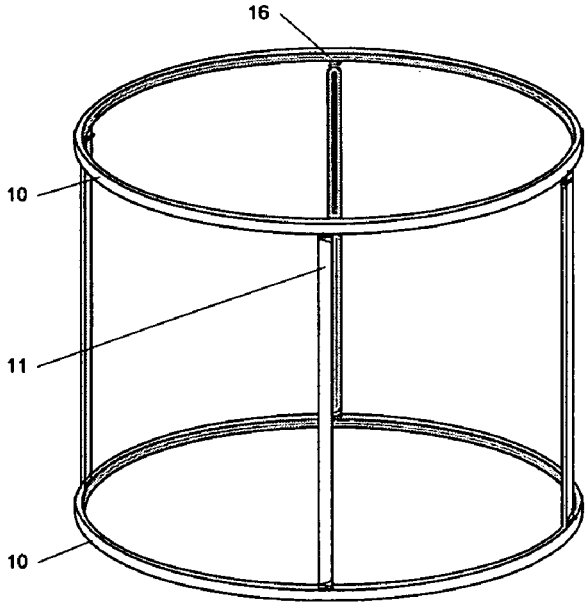
FIGS. 9 through 13—Illustrating the method steps by which a single person can easily collapse the bag, showing the frame only for clarity.
Figure 11:
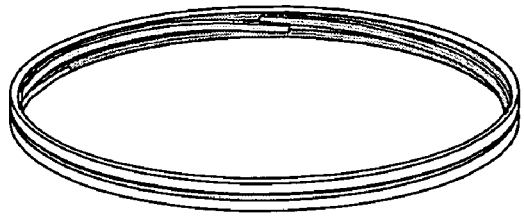
Figure 12:
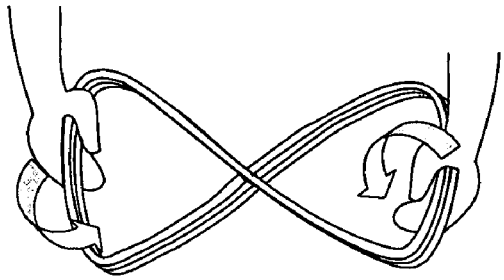
Figure 10:
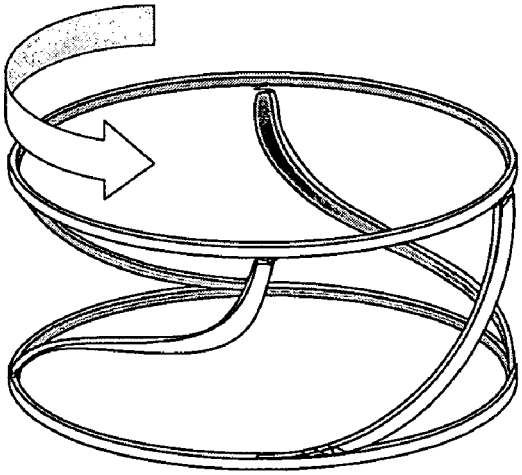
Figure 13:
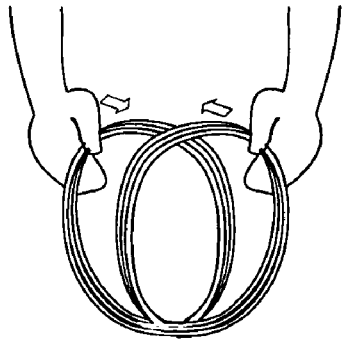

A preferred arrangement, wherein the vertical members 11 connect to the hoops 10 at the top and bottom via flexible spring hinges 16 as illustrated in FIGS. 3, 4 and 9. Flexible spring hinges form a semi-rigid connection which is capable of resisting rotation when fully expanded and form a free standing structure. However, in order to collapse the structure, when the hoops at the top and the bottom are grabbed and are rotated in opposing direction along a central longitudinal axis as illustrated in FIGS. 9 and 10, the connections bend to allow a flattening of the vertical members into a generally circular arrangement as shown in FIG. 11. The resulting hoop arrangement can then be further twisted and folded as shown in FIGS. 12 and 13 into a compact packet 22 to be kept in a box 23 for storage and sale. The packet containing folded hoops and folded vertical members are held in a collapsed state by a restraining mechanism or simply by the outer box. 23.

Figure 8:
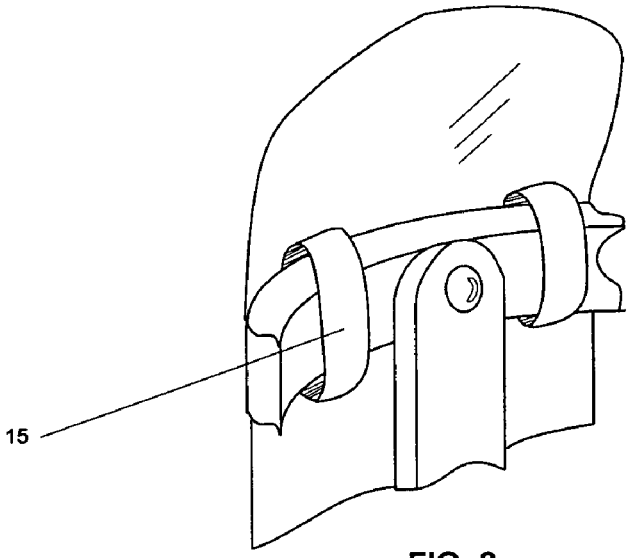
FIG. 8—Illustration of the bag membrane loosely attaching to the frame structure via loops or sleeves.

Additionally, the outer sheet covering 12 can be affixed to the frame by plastic heat stake or could be held loosely in place by retaining loops or sleeves 15 as illustrated in FIG. 8.

The top opening 14 as illustrated in FIG. 1 may be provided with an optional integrated closing mechanism such as one based on the draw string or lock ties.

Figure 5:
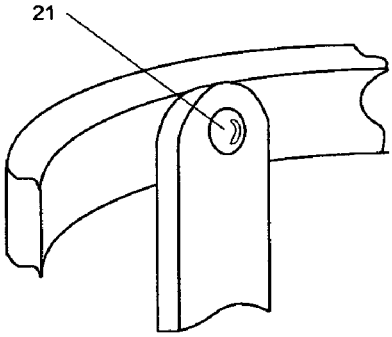
FIG. 5—Perspective view of a pin hinge connector mechanism for connecting members to the hoops.
Figure 6:
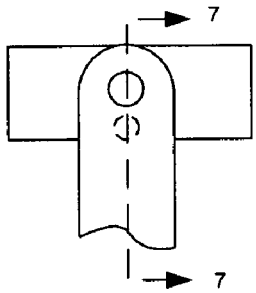
FIG. 6—Front view of a pin hinge connector mechanism.
Figure 7:
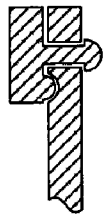
FIG. 7—Cross-sectional view along line 7-7 in FIG. 6.

FIGS. 5-7 illustrate an alternative arrangement, wherein snap pin connections 21 connect the hoops 10 at the top and bottom with the vertical members 11 and enable rotation at the pin joints, and at the same time provide a free-standing stable structure when the joint is snapped in position.

Figure 20:
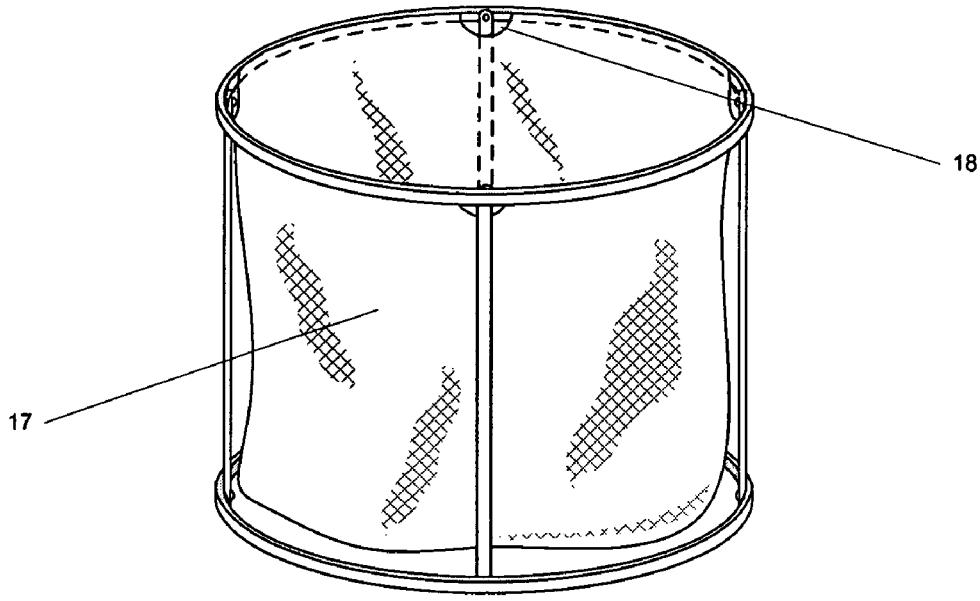
FIG. 20—Perspective top view of another embodiment of the pop-up disposable bag having a liner situated inside the structural members frame structure.

An alternative embodiment of the present invention as illustrated in FIG. 20, wherein the bag membrane 17 on the inside of the frame can be attached to the inside surface of the top hoop with cut-outs 18 around spring hinge joints for providing a free and untangled movement at the joints.

Figure 21:
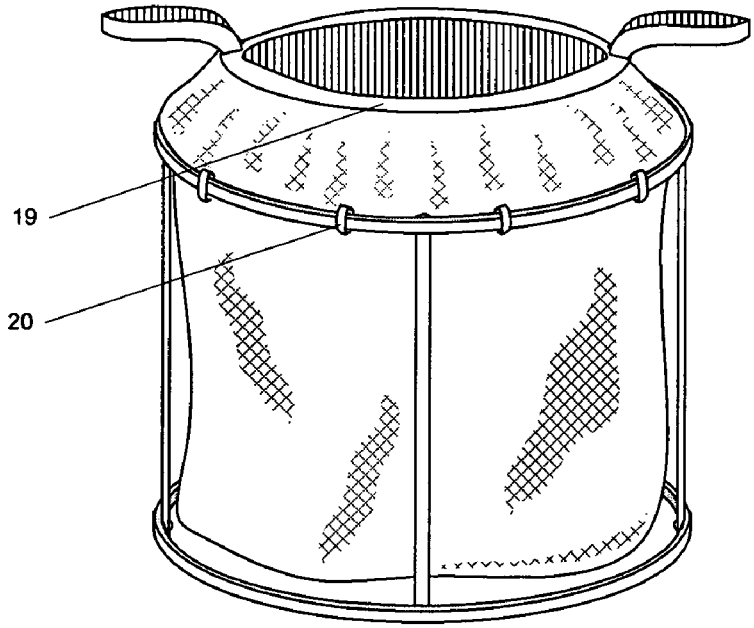
FIG. 21—Perspective top view of the alternative embodiment of the pop-up disposable bag with a drawstring closeable top opening.
Figure 22:
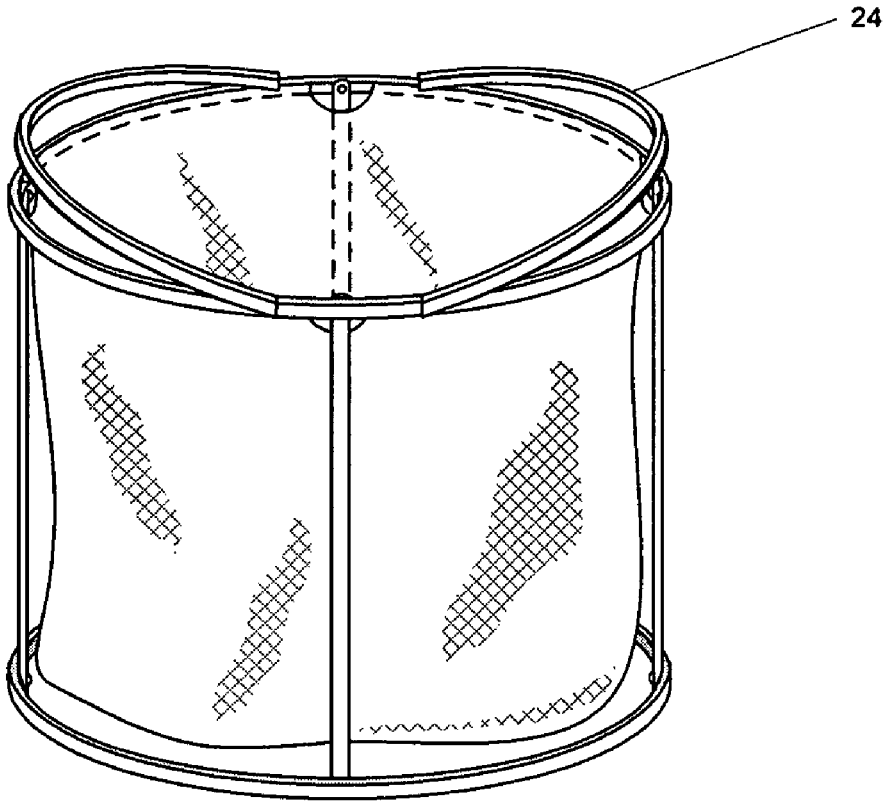
FIG. 22—Perspective top view of the alternative embodiment of the pop-up disposable bag having a liner situated inside the structural members frame structure, with collapsible handles on the top hoop.
Figure 23:
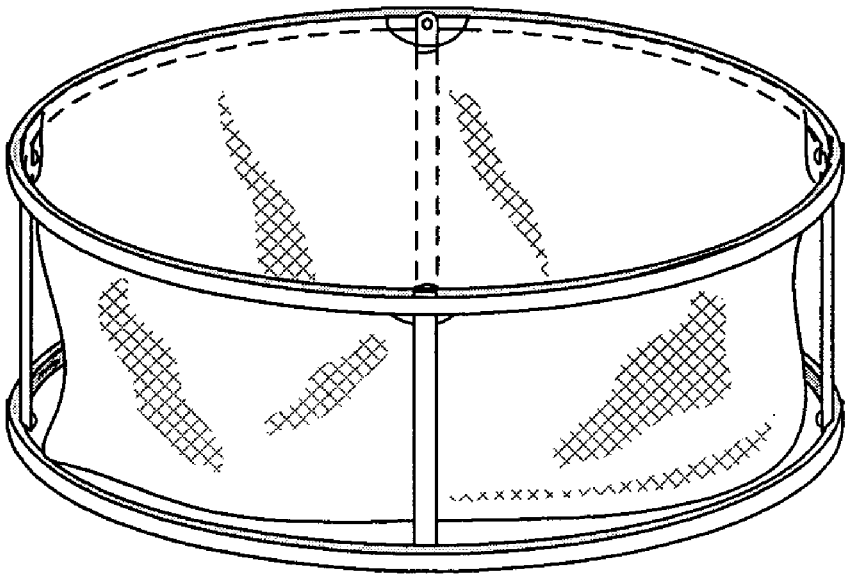
FIG. 23—Perspective top view of the pop-up disposable bag wherein the top and bottom hoops have wider openings compared to the height of the vertical members, thereby forming a basin or tub form factor.

Alternatively, the top of the bag can be loosely attached to the top hoop using loops or sleeves 20 as illustrated in FIG. 21.

The top opening 19 as illustrated with an optional integrated closing mechanism such as one based on the drawstring in FIG. 21.

OPERATION

The present invention is a system which improves the usability of a bag, such as a drawstring garbage bag, without the need for a separate supporting container or frame.

To collapse the bag, one person can easily disassemble the bag shown in FIGS. 1 and 2 into its compact form by twisting the structural hoops 10 of the bag in opposite directions to collapse the hinged vertical members 11 as illustrated in FIGS. 9 and 10, resulting in an oval arrangement of the hoops and vertical members as illustrated in FIG. 11, which can be further collapsed into concentric circular loops approximately one half in size by a simple twisting and folding motion as illustrated in FIGS. 12 and 13.

The collapsed compact system formed of smaller hoops remains collapsed until sufficient force is applied to cause them to open and attain the original shape of the bag. These smaller hoops remain collapsed and restrained by a retention mechanism such as an adhesive or tacky tab, or the master packaging itself, unless a sufficient force is applied to release the hoops from the retention mechanism, thereby allowing the hoops to spring open.

Figure 14:
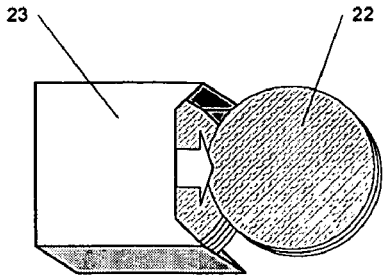
FIG. 14 through 19—Illustrating the method steps by which a single person can easily assemble the bag, showing the frame only for clarity.
Figure 17:
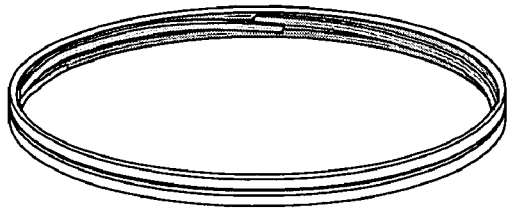
Figure 15:
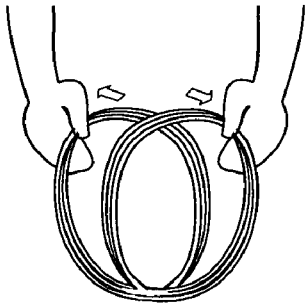

The collapsed system is light-weight and easily packaged in a box or container for sale and transport as illustrated in FIG. 14.

Figure 18:
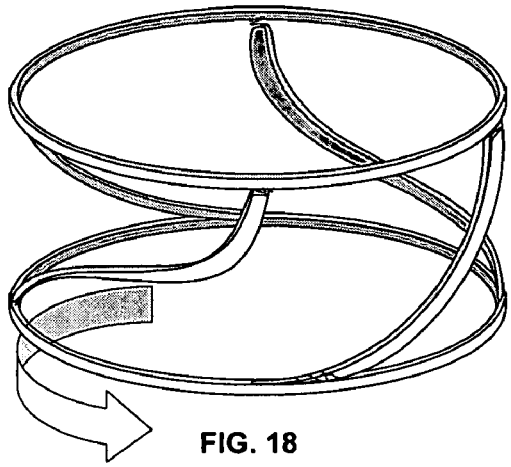
Figure 16:
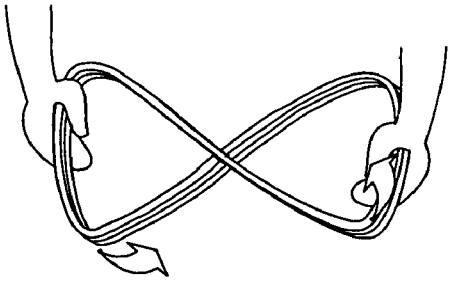
Figure 19:
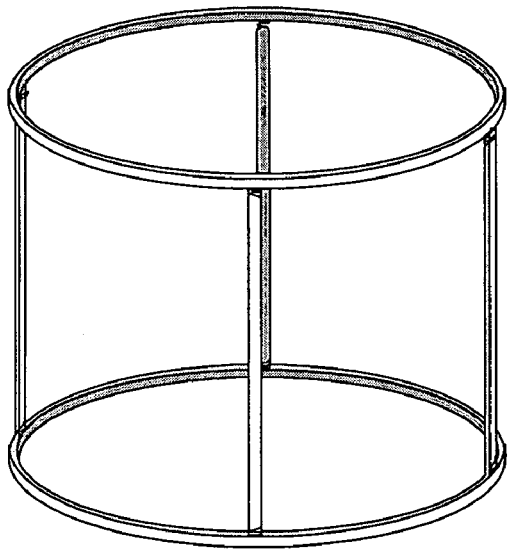

To open the bag of an alternative embodiment, wherein the pin hinge joints are used to connect the hoops to the vertical members, one person can grab the top and bottom concentric hoop members of the frame and rotate them in opposing directions within their respective planes as illustrated in FIG. 18 and to fully erect the frame into a self standing structure as illustrated in FIG. 19.

The bag thus formed is ready for use and can be filled from its opening at the top and when filled can be closed for disposal.

It is to be understood that the present invention is not limited to the embodiments described above, but encompasses any and all embodiments within the scope of the following claims.

What is claimed is:

1. A pop-up disposable bag comprising:

a frame comprised of a plurality of flexible members defining a circular hoop top;

a concentric circular hoop bottom and a sidewall formed of a plurality of vertical supporting members;

a liner forming an interior of the disposable bag;

said plurality of vertical supporting members each releasably attaches to the circular hoop top at one end and to the concentric circular hoop bottom at the other end thereby forming a freestanding tubular structure;

the releasably attachable means comprise a pin hinge connection with a positional snap mechanism; and the liner comprises a circular top, a circular bottom and a cylindrical sidewall and additionally the circular top having a plurality of cutouts formed therein.

2. The disposable bag of claim 1, wherein the liner forming the interior of the disposable bag is affixed to an inside surface of the circular hoop top.

3. The disposable bag of claim 2, wherein the circular top hoop includes optional integrated handles for easier carrying while collecting materials to be stored in the bag.

4. The disposable bag of claim 1, wherein the cutouts formed in the circular top are aligned with a pin hinge connection with a positional snap mechanism whereby to allow for an un-encumbered movement.

5. The disposable bag of claim 1, wherein the disposable bag having an opening at the top which is configured and sized for filling the bag with garbage and waste.

* * * * *